US006838999B1

(12) United States Patent
Röpke

(10) Patent No.: US 6,838,999 B1
(45) **Date of Patent: *Jan. 4, 2005**

(54) METHOD AND DEVICE FOR AUTOMATICALLY ALLOCATING DETECTOR ADDRESSES IN AN ALARM SYSTEM

(75) Inventor: Gerhard Röpke, Lubeck (DE)

(73) Assignee: Job Lizenz GmbH & Co. KG, Ahrensburg (DE)

( * ) Notice: Subject to any disclaimer, the term of this patent is extended or adjusted under 35 U.S.C. 154(b) by 442 days.

This patent is subject to a terminal disclaimer.

(21) Appl. No.: 09/856,667

(22) PCT Filed: Jun. 6, 2000

(86) PCT No.: PCT/EP00/05179

§ 371 (c)(1),
(2), (4) Date: Aug. 29, 2001

(87) PCT Pub. No.: WO01/16911

PCT Pub. Date: Mar. 8, 2001

(30) Foreign Application Priority Data

Aug. 27, 1999 (DE) ..... 199 40 700

(51) Int. Cl.[7] ..... G08B 26/00
(52) U.S. Cl. ..... 340/825.52; 340/524; 324/523
(58) Field of Search ..... 340/825.52, 505, 340/524; 375/257; 324/523

(56) References Cited

U.S. PATENT DOCUMENTS 4,612,534 A * 9/1986 Buehler et al. ..... 340/505
4,751,498 A * 6/1988 Shalvi et al. ..... 340/524
5,402,101 A 3/1995 Berger et al.
5,450,072 A 9/1995 Vockenhuber et al.
5,701,330 A * 12/1997 Lippmann et al. ..... 375/257
5,831,546 A * 11/1998 Costa et al. ..... 340/825.52
6,583,628 B2 * 6/2003 Ropke ..... 324/523

FOREIGN PATENT DOCUMENTS

| | | |
|---|---|---|
| DE | 25 33 354 | 1/1979 |
| DE | 25 33 382 | 7/1980 |
| DE | 25 33 330 | 8/1981 |
| DE | 32 25 032 | 6/1984 |
| DE | 32 11 550 | 2/1985 |
| DE | 4038992 C1 | 2/1992 |
| EP | 0042501 B1 | 6/1981 |
| EP | 0098552 | 2/1986 |
| EP | 0212106 | 4/1990 |
| EP | 0485878 B1 | 11/1991 |
| EP | 0546401 B1 | 6/1993 |
| EP | 0362985 B2 | 8/1994 |
| EP | 0854609 A3 | 1/1998 |

* cited by examiner

*Primary Examiner*—Edwin C. Holloway, III
(74) *Attorney, Agent, or Firm*—Vidas, Arrett & Steinkraus PA

(57) ABSTRACT

A process for automatically assigning detector addresses in a danger detection system, comprising a master station and at least one two-wire detection line linked thereto to which a multiplicity of detectors are connected wherein each detector has a capacitor for power accumulation, a measuring resistor in one wire, an evaluation device evaluating the voltage drop on the measuring resistor to which an address latch is connected, and a switch controllable by the evaluation device between the wires.

10 Claims, 2 Drawing Sheets

Figure 1:
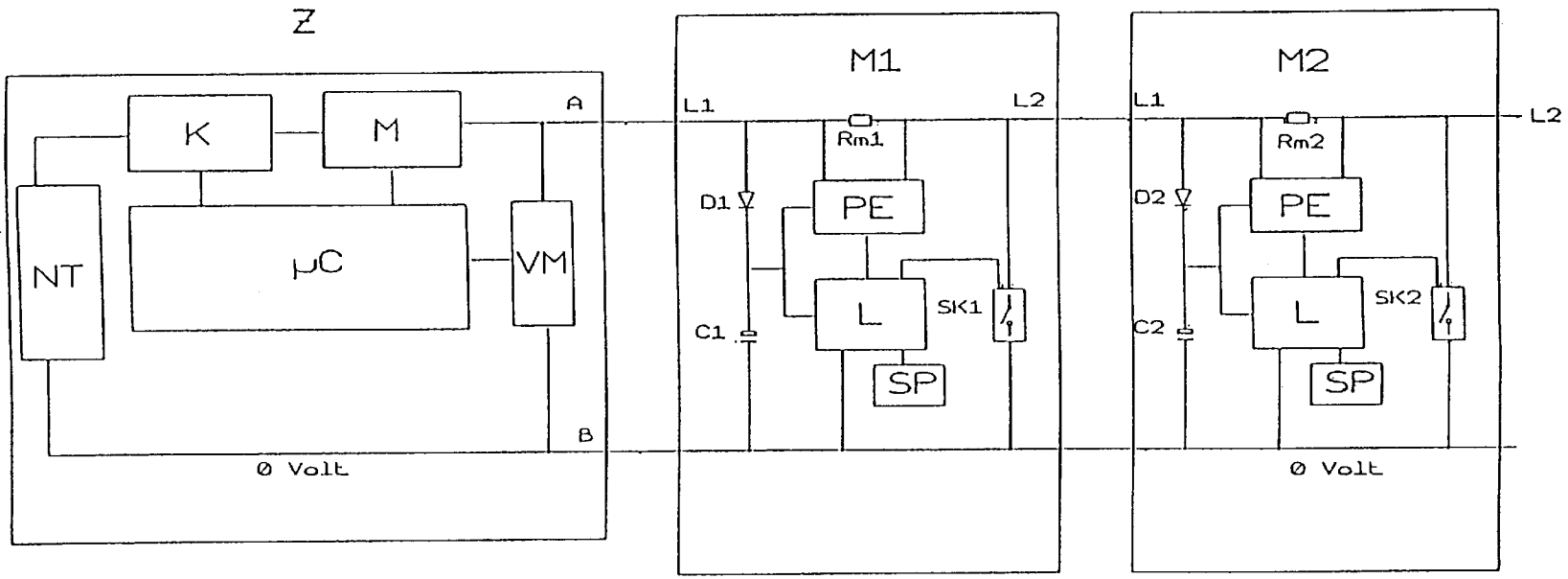

METHOD AND DEVICE FOR AUTOMATICALLY ALLOCATING DETECTOR ADDRESSES IN AN ALARM SYSTEM

The invention relates to a process for automatically assigning detector addresses in a danger detection system having a multiplicity of detectors according to claim 1.

As a rule, danger detection systems such as fire alarm systems have a major number of danger detectors which are linked to a two-wire detection line. It may be conceived as a tap line or also as a loop line via which the individual detectors communicate with a master station. Each detector has a sensor or the like which produces measured values depending on parameters of its environment. The measured values are transmitted to a master station through the line, which station usually interrogates the individual detectors cyclically. In order to assign the measured values to the individual detectors it is necessary to allocate an identifier or address to each detector. The address is archived in a non-volatile memory.

Therefore, if such a danger detection system is put into service, it is known to assign an address to the individual detectors at the beginning. To this end, it is preferred that an automatic process is employed.

In the state of the art, a number of processes to address and operate danger detection systems has become known to which brief reference will be made below.

From DE 25 33 330, it has been known that if the detectors are interrogated a line is caused to output a current pulse of a pulse duration proportional to its measured value after a lead time characteristic of each detector. The lead time is measured and is determined as the address of the individual detector in the central evaluation device. From DE 25 33 382, a process has been known in which the detectors of a line are electrically separated from the detection line at the start of each interrogation cycle and then are turned on in a chain-like way at a predetermined sequence. Each detector turns on the succeeding detector after an appropriate time lag. An evaluation device in the master station determines the respective increases in line current with the detector address corresponding to the number of increases in line current. Since it is impossible or not useful to process measured values from different detector types according to a unitary process it also has become known from DE 25 33 354 to assign timer elements to the individual detectors as is also the case in the above-described state of the art. The timer elements are used for transmitting control commands to the individual detectors on the line with the detectors being ready for reception only during the running period of the individual timer elements. Control devices provided in the detector can turn on one timer element each within a control cycle on the detection line with the time of start of the individual timer elements being evaluated as an address in the master station. In this connection, it further has become known from EP 0 098 552 that if a danger detection system is cyclically interrogated in each detector a timer element influencable by the measured value is switched to the detection line via a measuring transducer and the detector address is derived from the number of increases thus caused in line current in the master station. The running time of the timer element is controlled in each detector by means of an output signal formed in a signal converter, which represents the sum of the value measured by the detector and a detector identification signal, and both the value measured by the detector and the detector identifier of the detector concerned, in addition to the detector address from the respective switching delay, are derived in the master station.

To allow a major number of fire detectors to be connected to individual detection lines or to enable a higher current to be passed through the detection line it has become known from EP 0 042 501 to close the detection line in a loop-shaped way. The sense of interrogation is inverted if there are no signals on a detection line. Measured values are transmitted either via an appropriate time lag until the succeeding detector is turned on or in the form of a coded pulse sequence which is sent on to the master station.

From EP 0 212 106, it further has become known to assign address latches, which are engaged by addresses from the master station in a predetermined order, to the detectors in a chain-like line. This is done in a way that an address is not switched onto the next detector until an address is locked in the preceding detector. For this purpose, each detector has disposed therein a switch which short-circuits a wire to switch an address through to the next detector.

From DE 32 25 032, it has become known to make the desired distinction between the detector type, identifier, and measured value by using the control commands transmitted to the detectors from the master station to purposefully drive switch-over devices that change from transmitting values measured by the detectors over to transmitting detector identifiers. The respective detector identifier is then transmitted, via an interrogation cycle, to the master station where it is stored and subjected to further processing. Each detector has provided therein an device by which the detector identifier is adjusted, e.g. the detector type or detector condition.

A feature common to all detectors described is that they include a switch in series with a wire, which requires to be closed in order that the detector following next on the line be connected to the master station. In contrast, solutions are also known which provide other switching means to connect individual detectors in a chain-like fashion.

DE 32 11 550 provides a two-wire detection line in which each detector has a series resistor as well as a switch which is between the wires of the detection line and is closed in a case of alarm. The response of the detector causes a change to the total resistance of the detection line. A measuring and evaluation device disposed in the master station has a window comparator each which is assigned to a detector. Releasing the detectors at a resistance which is characteristic of such a comparator causes a respective measuring voltage. That window comparator which assigned to this measuring voltage will then switch its output to the indicator assigned to the alerted detector.

DE 40 38 992 has made known a process for automatically assigning detector addresses in a danger detection system in which a master station is connected to a two-wire detection line to which individual detectors are linked in a chain-like fashion. Each detector has a transmission device, a measured-values memory, an address latch, and a voltage measuring device as well as a switch. In a first phase, the master station applies a quiescent voltage to the line, which causes the detectors to be supplied with power via the charging of a capacitor. In a second phase, a short-circuiting voltage is applied to the line, which causes all detectors the address latches are empty to short-circuit the line by means of their switches. In a third phase, a measuring current is impressed on the line and the voltage which, as a result, drops on the first detector having a closed switch is determined by the voltage measuring device. In a fourth phase, an interrogation voltage is applied to the line, which causes the detector the measured-values memory of which is occupied but the address latch of which is empty to become capable of communication and is assigned an address, which is archived in the address latch, from the master station. The master station repeats this procedure as many times until all detectors are provided with addresses. The end of the procedure can be recognized by the master station by the fact that no short-circuit current flows any longer in the third phase.

The solution described last, on one hand, requires an expenditure, which is not insignificant, in switching the detectors. It further necessitates a major addressing period. The above-described phases 2 to 4 have to be repeated for each detector of a line, which takes a major period of time, particularly if there is a major number of detectors in a network.

The state of the art includes even more addressing or detector identification processes. Such a process is described, for example, in EP 0 546 401 and consists in that the detector base of each detector houses an identification module and that a non-modifiable identification number is provided for each detector base and differs from the one of the other detector bases. The detector has provided therein means which recognize the identification number. The identification module housed in the detector base is formed either by a resistor combination, a ROM, a PROM, an EPROM, an EEPROM or an optical division mark. The identification number is read via contacts or an optical transmission device. The detector base is localized either by inserting the detector in a predetermined order, by alerting the detector for the first time when putting it into service for the first time, e.g. by means of a test gas, in the predetermined order, or by assigning the address thereto by means of a programming device prior to insertion. EP 0 362 985 makes an attempt to improve the above-described problematic addressing process by the fact that a mechanical device disposed in the detector base which can be manually adjusted to a binary code presses appropriate resilient elements of the inserted measuring head for the transmission of the detector address. It is true that this facilitates an exchange of detectors for maintenance purposes. This solution also requires a time-consuming manual adjustment of the coding for the base address. Further, the unstable spring elements and points of contact represent a risk to safety.

Finally, EP 0 485 878 has made known a process for determining the configuration of the detectors in a danger detection system in which a binary serial number is stored by the manufacturer in each detector. For installation, 12 process steps which are complex and partially consume a lot of time are carried out to determine the number of detectors in the system, their location, and their way of networking by establishing their serial numbers. The more complex the networking of loop lines and tap lines is the more tedious is the known process.

It is the object of the invention to provide a process for automatically assigning detector addresses in a danger detection system which requires little expenditure in switching the individual detectors, can be performed within a short period, and operates without any errors with a large number of detectors even if transmission lines are long.

This object is achieved by the features of claim 1.

In the inventive process, a voltage is applied to the line, which causes the capacitors to be charged, in a first phase as in the generic state of the art. This ensures power supply to the detectors at a short term. In a second phase, the master station emits a switch signal to close the switches of all detectors. According to an aspect of the inventive process, this switch signal is formed by a voltage-modulated data word of the master station. In a third phase, constant currents having varying levels are impressed on the line at a predetermined alternation immediately after the switches are closed. The varying-level constant current produces varying voltage drops on the measuring resistor of all detectors the switch of which is opened and, hence, on the detector to be addressed, which voltage drops are transformed by a pulse receiver in the detector into a digital signal constituting a data word. This digital signal is directly input, as an address, in the memory provided this one is not occupied yet by an address. Once this operation is completed the logic circuit opens the switch and blocks another data word from being rolled into the address latch.

During the addressing operation described, the succeeding detectors do not receive any voltage pulses adapted to be evaluated via their resistors and, hence, any communication address because the switch of the addressed detector short-circuits the line to prevent transmission to the succeeding detectors. After the addressed detector stores its address its switch will be opened as mentioned above.

The master station can allow one of the impressed currents to flow on. The master station registers the opening of the switch as a voltage jump at the terminals. This one may be used as a acknowledge signal for the fact that the first detector has duly received its communication address. Immediately afterwards, the master station emits another communication address which also is formed by an impressed, current-modulated signal from the two constant currents. Since the switch of the first detector is opened the second detector will also receive voltage pulses adapted to be evaluated via its measuring resistor. All of the other detectors will receive no voltage pulses adapted to be evaluated via their measuring resistors. After archiving its address, the second detector opens its switch. Regarding all other detectors, the master station repeats the last described step each by another data word. As a result, and because communication addresses are emitted in a speedy manner a multiplicity of detectors are assigned a communication address. Once the assignment of communication addresses is completed the master station will no longer receive a voltage jump. Therefore, the master station can consider the automatic operation completed.

A circuitry for attaining the inventive object provides a capacitor connected in series with a diode, a controllable switch between the wires, a measuring resistor within the course of a wire, a pulse receiver, a logic circuit, and an address latch connected to the logic circuit for each of the detectors connected to the two-wire detection line. As was explained previously the impressed constant currents produce voltage pulses on the measuring resistor, which are evaluated by the pulse receiver. The logic circuit provides for them to be fed into the address latch. A simple standard amplifier having a fixed gain factor and a following transistor stage may be provided for the pulse receiver. In an aspect of the invention, an alternative provision is made to use the microprocessor for this purpose, which microprocessor usually is disposed in each detector to perform measurements and communication with the master station. The pulse receiver has provided therefor the A/D converter of the microprocessor and an appropriate program for the microprocessor. Therefore, no additional expenditure is necessary to switch the pulse receiver. Impressing constant currents on the detection line ensures that equally large voltage drops are produced on each measuring resistor of the detectors, which are completely independent on the number of detectors, the length of the detection line, and other line parameters.

If a mechanical switch, e.g. the one of a relay, was provided for each detector its resistance conditions which are nearly ideal would also result in clear voltage conditions between the respective measuring resistance prepared to receive addresses, which is identical for all of the detectors, and the resistances of the short-circuited detectors which follow. For reasons of cost, but also for technical reasons, preference is given to using semiconductor switches such as FET switches. Those, when turned on which makes them conductive, have a volume resistivity which may be less than 50 milliohms. This will form correspondingly lesser voltage drops above the connections of each electric switch. These residual voltages can still be measured on the succeeding measuring resistor of the detectors which still are short-circuited. Thus, not all of the current that the master station impresses on the line will flow through the respective short-circuited detector. Therefore, an aspect of the invention provides that the ratio of the resistance from the measuring resistor to the resistance of the through-switched semiconductor switch be more than 10:1. In this way, a distinct identification is reached for the detector prepared to be addressed as seen from the master station. In view of the required line lengths, cable cross-sections, and a number of detectors which is 128 in a loop line, for example, it is practicable to automatically address all of the detectors according to the inventive process within a short period if the common supply voltage is 24 volts, for example. If there are common conditions of installation the voltage signal, which is produced by the impressed constant currents via the measuring resistance of the detector being addressed, is by a multiple higher than is the voltage drop on the succeeding detector which still is short-circuited with a semiconductor switch.

Summarizing, it may be stated that the inventive process allows to automatically assign addresses within a short period at a low expenditure in switching even if danger detection systems are very extensive. Since each detector is utilized for the addressing operation only for a small period of time the capacitor may be designed to be relatively small, which will further reduce expenditure.

The invention will now be explained below with reference to an embodiment illustrated in the drawings.

FIG. 1 schematically shows a circuitry to perform the process according to the invention.

Figure 2:
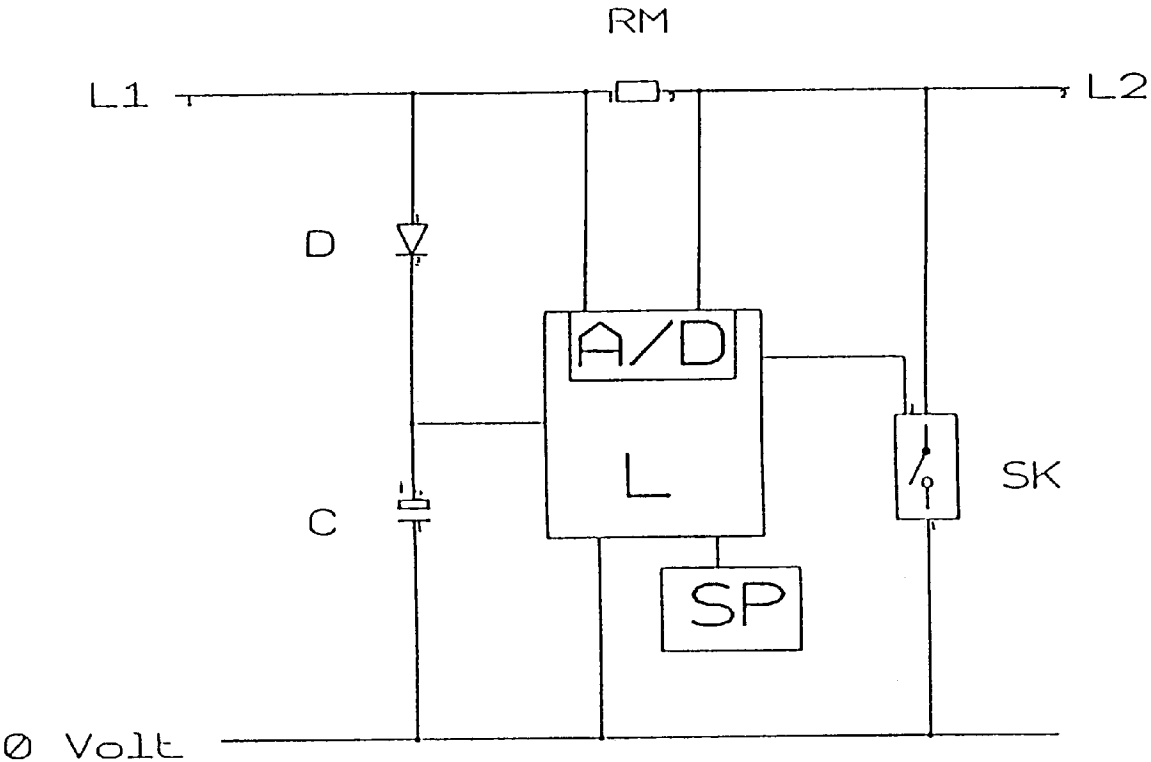

FIG. 2 shows another embodiment of an addressing circuit of a detector for the danger detection system of FIG. 1.

Referring to FIG. 1, a master station Z is shown for a danger detection system such as a fire alarm system, to which a transmission line is connected which has wires A and B. The transmission line may be a tap line or loop line as is known as such. The master station has a voltage supply in the form of a power pack NT, a microprocessor $\mu$C, a constant-current source K, a modulator M, and a voltage measuring device VM. Reference to the function of the individual elements will be made later below.

The transmission line has connected thereto a multiplicity of detectors, e.g. 128. However, FIG. 1 only illustrates two detectors M1 and M2. Each of the detectors M1 and M2 has a resistor Rm1 and Rm2, respectively, in the course of a wire, a capacitor C1 and C2, respectively, in series with a diode D1 and D2, respectively, between the wires, a controllable switch SK1 and SK2, respectively, a pulse receiver PE, a logic circuit L, and an address latch SP. Each detector includes a number of further elements which are required to operate it. However, since what is described here merely is how to assign an address to each detector those elements are neither shown nor will they be described.

The assignment of addresses to the individual detectors from M1 to Mn will now be described with reference to FIG. 1.

In a first phase, the master station Z connects a supply voltage to the transmission line. The supply voltage passes to all detectors M1, M2 . . . Mn via the identically dimensioned measuring resistors Rm1, Rm2 . . . Rmn. Their capacitors C1, C2 . . . Cn are charged via the diodes D1, D2 . . . Dn. The capacitors, when charged, supply the logic circuits L, the address latches SP, and the pulse receivers PE with electric power during the addressing phase. The switches SK1, SK2 . . . SKn are opened and do not carry a current.

In a second phase, the master station Z emits a voltage-modulated data word, as a collective "initialize" command, to all detectors M1, M2 . . . Mn by means of the modulator M. The circuit required for this purpose corresponds to the state of the art and will not be described in detail. The demodulators required for reception in the detectors are irrelevant in assigning addresses to the detectors and, therefore, are not shown in FIG. 1. Upon reception of this command, all detectors M1, M2 . . . Mn turn on their switches SK1, SK2 . . . SKn.

In a third phase, the master station emits a data word to the transmission line by means of the constant-current source K and the microprocessor $\mu$C. The data word comprises a predetermined alternation of two impressed currents Ik0 and Ik1. On the resistor Rm1 of detector M1, the two currents cause voltage pulses which are transformed into digital signals by means of the pulse receiver PE. The logic circuit L passes the data word, which is interpreted as a communication address, on to the non-volatile address latch SP. The detector M2 and all succeeding detectors do not receive any voltage pulses adapted to be evaluated via their resistors Rm2 . . . Rmn and, thus, any communication address because the switch SK1 short-circuits the line to prevent transmission to the succeeding detectors M2 . . . Mn.

After detector M1 stores its address in SP SK1 will be opened. This may be accomplished, for example, by the fact that the master station, immediately after the address is emitted from the master station Z and is stored in detector M1, emits a current-modulating logic signal, which causes the logic circuit L in detector M1 to open its switch SK1. In this way, a voltage jump occurs at the output of the master station Z, which is considered to be an acknowledgement that an address was assigned to detector M1. The voltage jump is measured at the current measuring device VM which is connected to microprocessor $\mu$C.

Subsequently, the master station Z emits another address which also is formed by an impressed, current-modulated serial signal from the constant currents Ik0 and Ik1. Since switch SK1 is opened the second detector M2, via its measuring resistor Rm2, will also receive voltage signals adapted to be evaluated which are evaluated by the pulse receiver PE. The logic circuit of the first detector M1 ignores this address signal because its address latch is occupied already. Then, the addressing operation continues as was described for M1 already. This step is repeated by the master station for each detector. As the communication addresses are emitted in a speedy way this provides a multiplicity of detectors with an address within a short period. Once the assignment of addresses is completed this can be established by the master station by the fact that the voltage measuring device no longer registers a voltage jump at its connections from the voltage measuring device VM.

Referring to FIG. 2, a detector is shown with regard to its addressing circuit, which partially has the same elements as the detectors M1 and M2 of FIG. 1. As can be seen a logic circuit L is shown which has an integrated A/D converter instead of the pulse receiver PE. Those are "components" of a microprocessor commonly installed in the detector the A/D converter and the program of which compares the voltages dropping on the measuring resistor Rm to predetermined digital values. The data word formed therefrom is interpreted as an address and is archived in the address latch SP provided that it is empty. The remaining process steps are identical to those previously described.

What is claimed is:

1. A process for automatically assigning detector addresses in a danger detection system, comprising a master station and at least one two-wire detection line linked thereto to which a multiplicity of detectors are connected wherein each detector has a capacitor for power accumulation, a measuring resistor in one wire, an evaluation device evaluating the voltage drop on the measuring resistor to which an address latch is connected, and a switch controllable by the evaluation device between the wires, including the following process steps:

In a first phase, a voltage is applied to the line from the master station and the capacitors are charged, in a second phase, the master station emits a switch signal to close the switches of all detectors on the detection line, in a third phase, two constant currents having different levels are impressed on the detection line at a predetermined alternation and are transformed by means of a pulse receiver in the detector into a digital signal constituting a data word which is stored in the address latch, and a logic circuit blocks another information from being rolled into the address latch and opens the switch, and the third phase is repeated with another data word for each detector ready for reception the address latch of which is not occupied.

2. The process according to claim 1 wherein the switch is opened by a current-modulated signal of the master station which is detected in the evaluation device and is used by it for producing a control command for the switch.

3. The process according to claim 1 wherein one of the two currents continues to flow while or after the switch is opened and the master station determines an acknowledge signal from the voltage jump for the purpose of producing a next serial signal consisting of the constant currents for the succeeding detector.

4. The process according to claim 3 wherein the master station terminates the assignment of addresses if a voltage jump is no longer found to exist.

5. The process according to claim 1 wherein the switch signal is constituted by a voltage-modulated data word of the master station.

6. A circuitry for automatically assigning detector addresses in a danger detection system, comprising:

a master station (Z) which has a power supply (NT), a microprocessor ($\mu$C), a constant-current source (K), and a current modulator (M), a multiplicity of detectors (M1, M2 . . . Mn) which are connected to at least one two-wire detection line (A, B) wherein each detector (M1, M2 . . . Mn) has a capacitor (C1, C2 . . . Cn) connected between the wires (A, B) in series with a diode (D1, D2 . . . Dn), a controllable switch (SK1, SK2 . . . SKn) between the wires (A, B), a measuring resistor (Rm1, Rm2 . . . Rmn), a pulse receiver (PE) disposed on the measuring resistor, a logic circuit (L), and an address latch (SP) connected to the logic circuit (L), and wherein the logic circuit (L) is designed so as to close the switch (SK1, SK2 . . . SKn) during a first pulse sequence arriving from the pulse receiver (PE), and inputs it into the address latch (SP) if this one is not occupied yet by an address, during a second pulse sequence arriving from the pulse receiver (PE).

7. The circuitry according to claim 6, characterized in that a semiconductor switch, is provided as a switch and the ratio of resistance from the measuring resistor (Rm1, Rm2 . . . Rmn) to the resistance value of the switched-through semiconductor switch is more than 10:1.

8. The circuitry according to claim 6, characterized in that the detector (M) includes a microprocessor and the pulse receiver is constituted by the A/D converter and the program of the microprocessor.

9. The circuitry according to claim 6, characterized in that the master station (Z) has a voltage measuring device (VM) connected to the wires (A, B).

10. A circuitry for automatically assigning detector addresses in a danger detection system, comprising:

a master station (Z) which has a power supply (NT), a microprocessor ($\mu$C), a constant-current source (K), and a current modulator (M), a multiplicity of detectors (M1, M2 . . . Mn) which are connected to at least one two-wire detection line (A, B) wherein each detector (M1, M2 . . . Mn) has a capacitor (C1, C2 . . . Cn) connected between the wires (A, B) in series with a diode (D1, D2 . . . Dn), a controllable switch (SK1, SK2 . . . SKn) between the wires (A, B), a measuring resistor (Rm1, Rm2 . . . Rmn), a pulse receiver (PE) connected parallel to the measuring resistor, a logic circuit (L), and an address latch (SP) connected to the logic circuit (L), and wherein the logic circuit (L) is designed so as to close the switch (SK1, SK2 . . . SKn) during a first pulse sequence arriving from the pulse receiver (PE), and inputs it into the address latch (SP) if this one is not occupied yet by an address, during a second pulse sequence arriving from the pulse receiver (PE).

* * * * *